US007632129B2

(12) United States Patent
Lin

(10) Patent No.: US 7,632,129 B2
(45) Date of Patent: Dec. 15, 2009

(54) SOCKET CONNECTOR HAVING ELASTIC MECHANISM

(75) Inventor: Chun-Fu Lin, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/228,573

(22) Filed: Aug. 13, 2008

(65) Prior Publication Data

US 2009/0047819 A1 Feb. 19, 2009

(30) Foreign Application Priority Data

Aug. 14, 2007 (TW) ..... 96213372 U

(51) Int. Cl.
*H01R 13/62* (2006.01)

(52) U.S. Cl. ..... 439/342

(58) Field of Classification Search ..... 439/342, 439/70–73, 331

See application file for complete search history.

(56) References Cited

U.S. PATENT DOCUMENTS 5,057,031 A * 10/1991 Sinclair ..... 439/261
6,887,090 B2 * 5/2005 Lin et al. ..... 439/342
6,893,283 B2 * 5/2005 Yu ..... 439/342
7,033,200 B2 * 4/2006 Cui et al. ..... 439/342
2004/0224548 A1 * 11/2004 Yu ..... 439/342
2005/0020118 A1 * 1/2005 Norris et al. ..... 439/342

FOREIGN PATENT DOCUMENTS

TW 470224 12/2001

* cited by examiner

*Primary Examiner*—Gary F. Paumen
(74) *Attorney, Agent, or Firm*—Andrew C. Cheng; Wei Te Chung; Ming Chieh Chang

(57) ABSTRACT

An electrical connector includes a frame (2) is a substantially rectangular configuration and including a front portion and rear portion (22), a cover (3) moveably disposed on the frame and including a supporting portion (31) with a plurality of holes (311) defined therein, a lever (4) having a shaft portion (42) disposed on the rear portion of the frame to drive the cover to move from a first position to a second position, a base (1) disposed within the frame and under the cover and an elastic mechanism received between the base and the cover. The cover further defines a groove (33) which is used for receiving the elastic mechanism when the cover is in the second position.

17 Claims, 8 Drawing Sheets

SOCKET CONNECTOR HAVING ELASTIC MECHANISM

BACKGROUND OF THE INVENTION

1. Field of the Invention

The present invention relates to a socket connector, and more particularly to a ZIF (zero-insertion-force) connector having a base detachably assembled with a metal frame for easily facilitating installation of the base onto a printed circuit board.

2. Description of the Related Art

The IC packages are more and more popular in the computer industry. As well known, the IC package is commonly connected to a mother board through a socket connector which is directly mountably soldered on the mother board. Taiwan Patent Number 470224 issued on Dec. 21, 2001 discloses a socket connector including a base, a cover slidably mounted to the base and a lever including an actuation handle and a cam portion joined with each other. The cam portion is received between the base and the cover, and the handle is exposed to one side of the base. When the handle is in a horizontal position, conductive pins of the IC package loaded onto the cover will engage with conductive means of the socket connector and the socket connector is in a closed state. After the lever is driven to a vertical position, the IC package can be easily pulled out from the socket connector.

But this type of the socket connector has a potential disadvantage during the lever is driven to the vertical position. A user is not sure whether the socket connector is in the open state or not, resulting in damage of the conductive pins of the IC package and the socket connector when the package is pulled out in a condition that the cover is non-completely opening.

Hence, a new design which can protect the conductive pins of an IC package and a socket connector is required.

SUMMARY OF THE INVENTION

Accordingly, an object of the present invention is to provide an electrical connector with elastic mechanism to sure the lever to be in a complete opening state.

In order to achieve the object set forth, an electrical connector includes a frame is a substantially rectangular configuration and including a front portion and rear portion, a cover moveably disposed on the frame and including a supporting portion with a plurality of holes defined therein, a lever having a shaft portion disposed on the rear portion of the frame to drive the cover to move from a first position to a second position, a base disposed within the frame and under the cover and an elastic mechanism received between the base and the cover. The cover further defines a groove which is used for receiving the elastic mechanism when the cover is in the second position.

Other objects, advantages and novel features of the invention will become more apparent from the following detailed description of the present embodiment when taken in conjunction with the accompanying drawings.

DETAILED DESCRIPTION OF THE INVENTION

Figure 1:
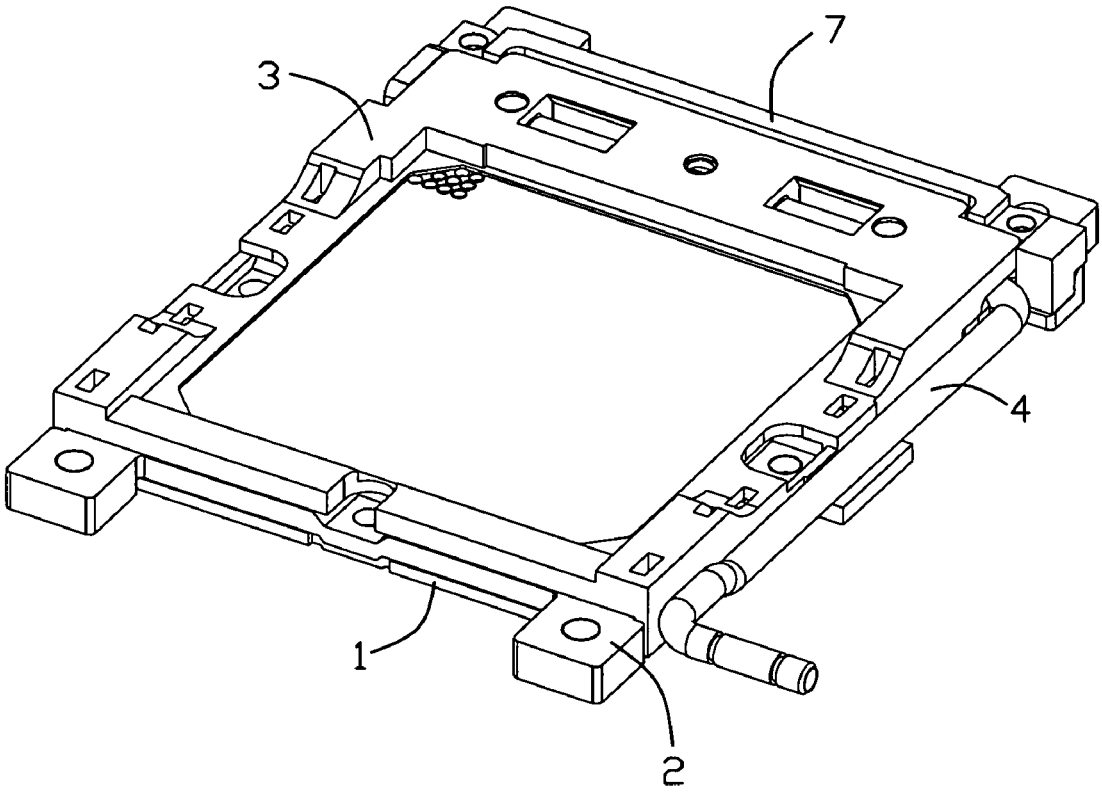
FIG. 1 is a perspective view of an electrical connector in accordance with the present invention, showing the electrical connector in a closed state.

Reference will now be made to the drawing figures to describe a preferred embodiment of the present invention in detail.

Figure 2:
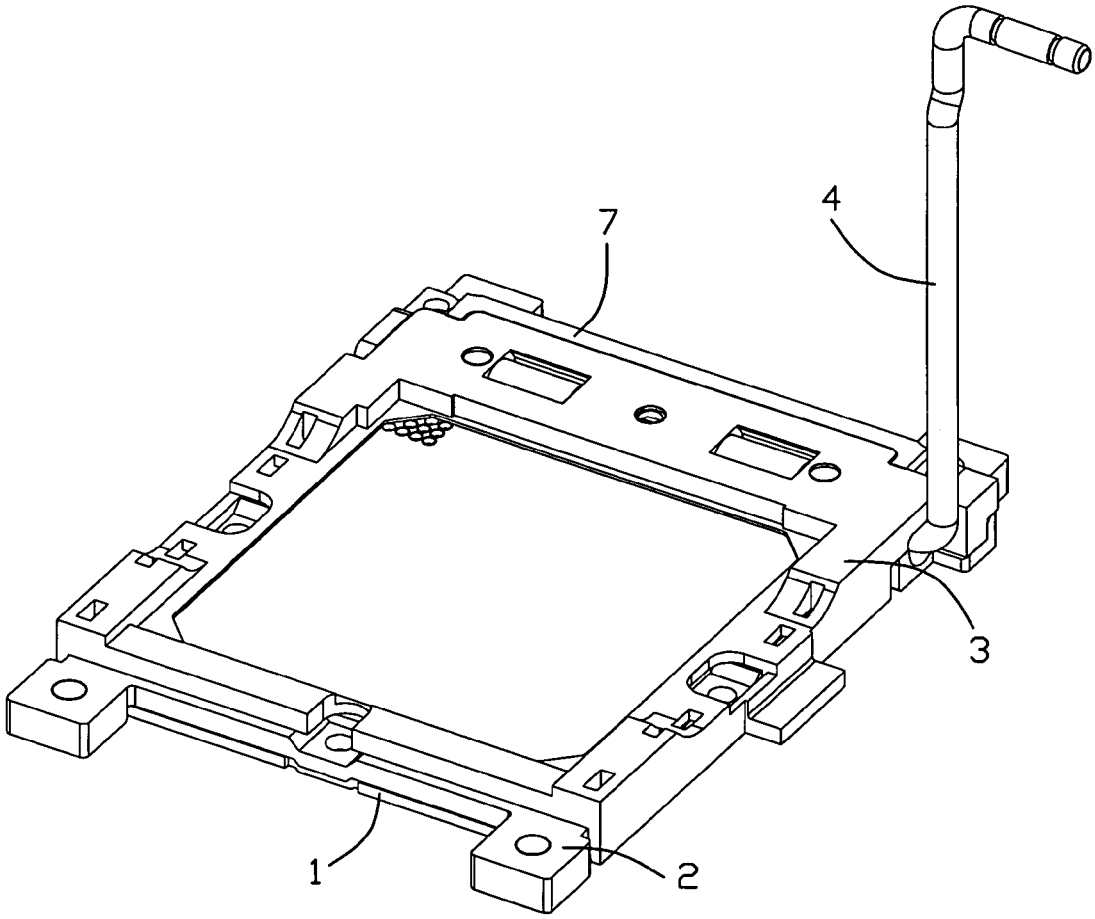
FIG. 2 is a perspective view of the electrical connector shown in FIG. 1, showing the electrical connector in an open state.
Figure 3:
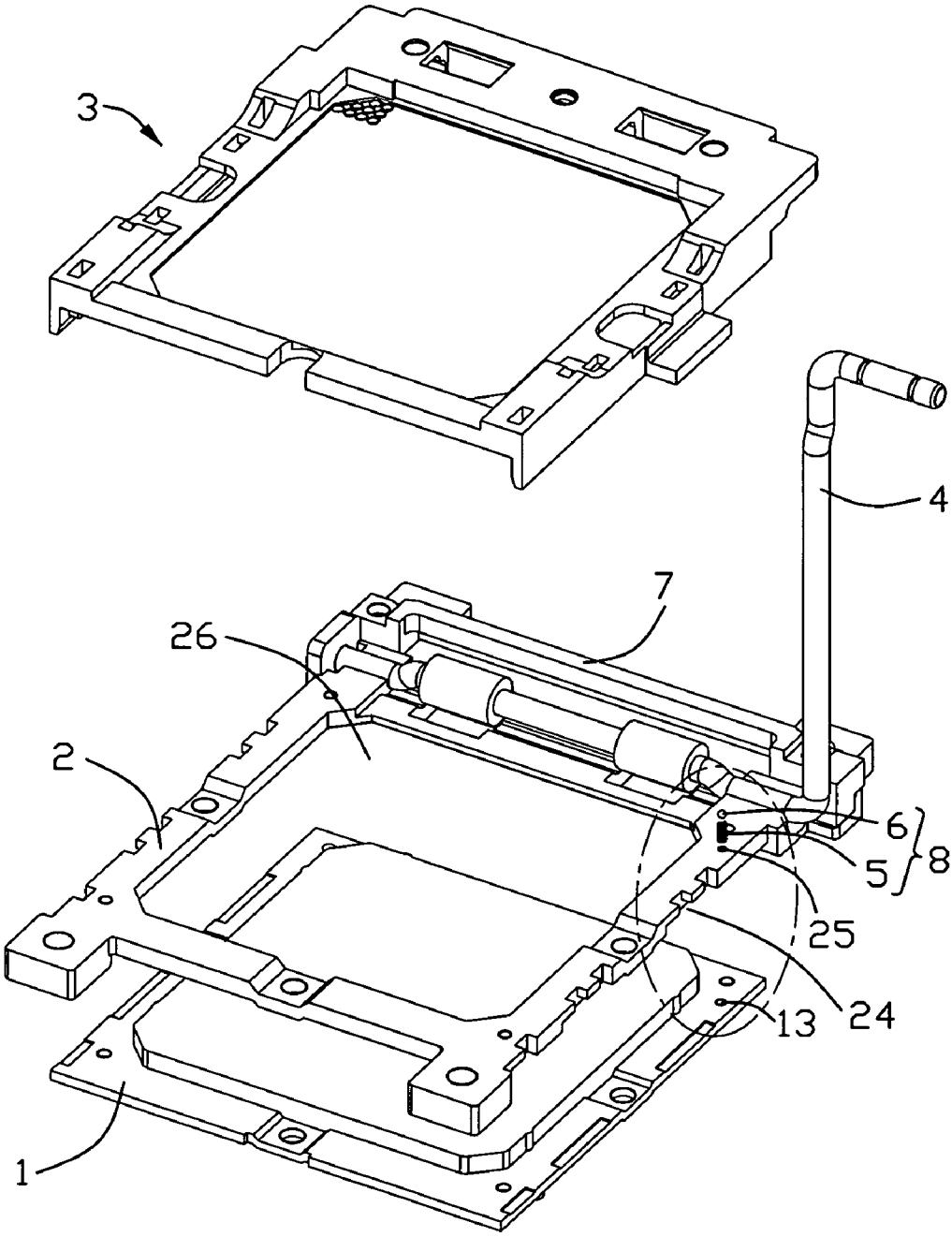
FIG. 3 is a partly exploded view of the electrical connector shown in FIG. 2.
Figure 4:
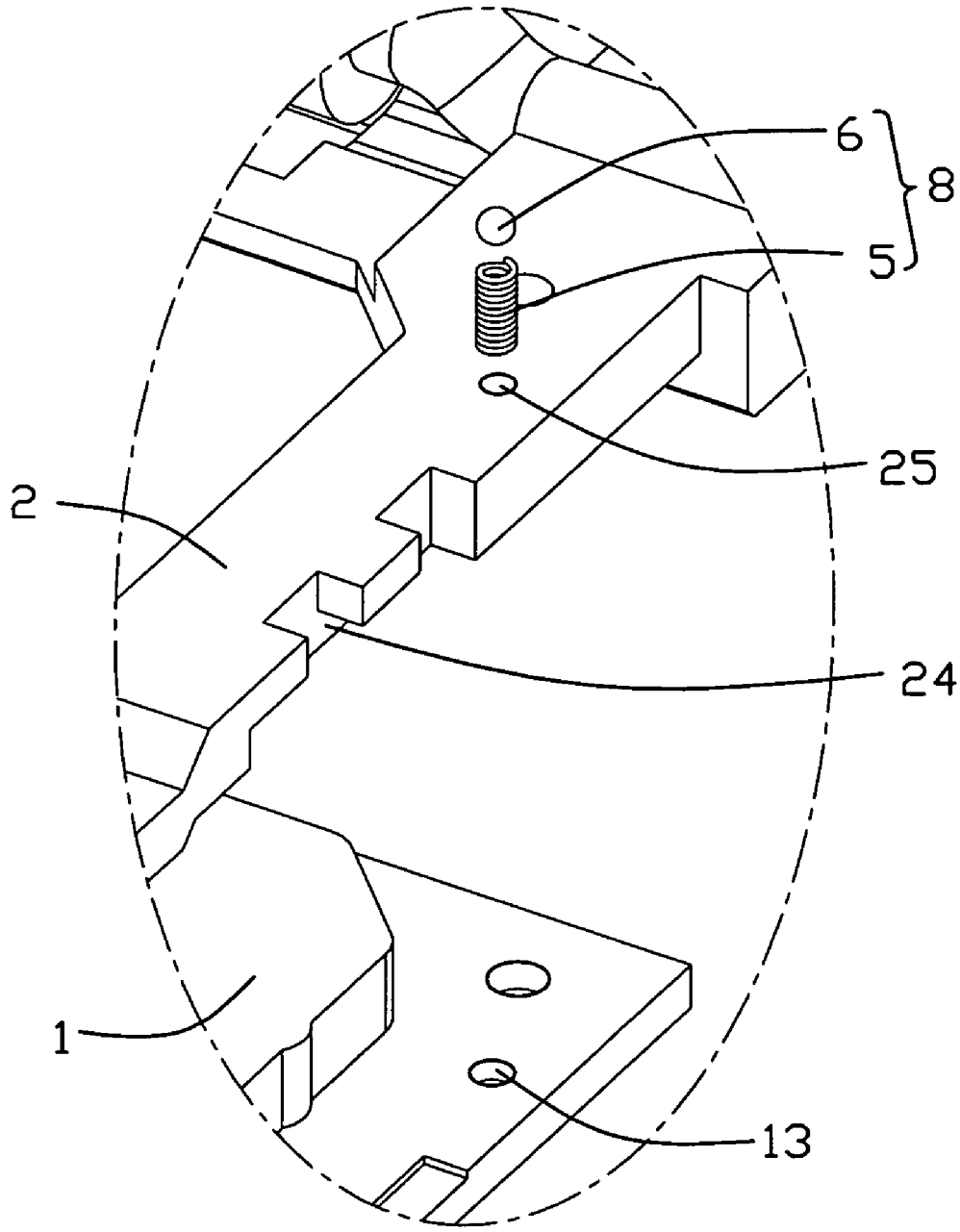
FIG. 4 is an amplificatory portion in the circle with broken line shown in FIG. 3.

Referring to FIG. 1 to FIG. 3, an electrical connector for connection of an IC package and a circuit member, includes a base 1 receiving a plurality of terminals therein (not shown), a metal frame 2 assembled on the base 1, a cover 3 movably mounted on the frame 2, a lever 4 retained between the frame 2 and the cover 3 and an elastic mechanism 8.

Figure 6:
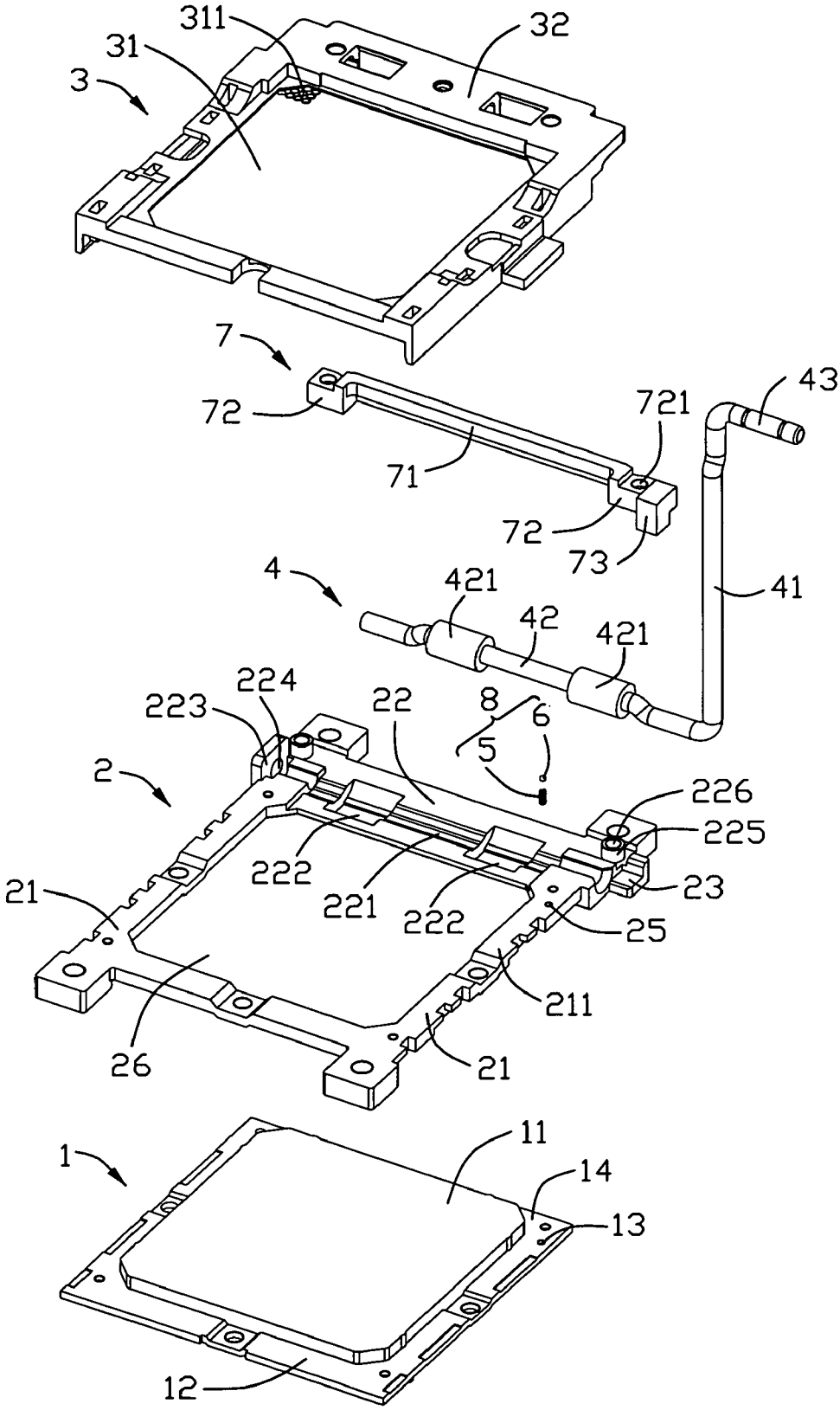
FIG. 6 is an exploded view of the electrical connector shown in FIG. 2.

Referring to FIG. 6, the base 1 of plate-like shape defines a terminals receiving portion 11 and an installing portion 12 surrounding the receiving portion 11. The receiving portion 11 projects from a center portion of the base 1 and defines a plurality of receiving grooves (not shown) for receiving the terminals. The installing portion 12 defines a receiving hole 13 at a side portion running through a top face 14 thereof.

The frame 2 defines two opposite side portions 21 and a third side portion 22 connecting the two side portions 21 at the back portion thereof, the third side portion 22 is defined as a rear portion, the frame 2 further defines a front portion opposite to the rear portion 22. The third side portion 22 defines a larger width than each side portion 21. A first channel 221 opens upwards along a longitudinal direction of the third side portion 22, and two separate communicating recesses 222 are transversely defined in the first channel 221 and open upward. One of the side portions 21 defines a through hole 25 running through the opposite top face 211 and bottom face thereof. The frame 2 further defines a stopper 223 extending upwardly from one end of the first channel 221, and a through hole 224 runs through the stopper 223.

Figure 5:
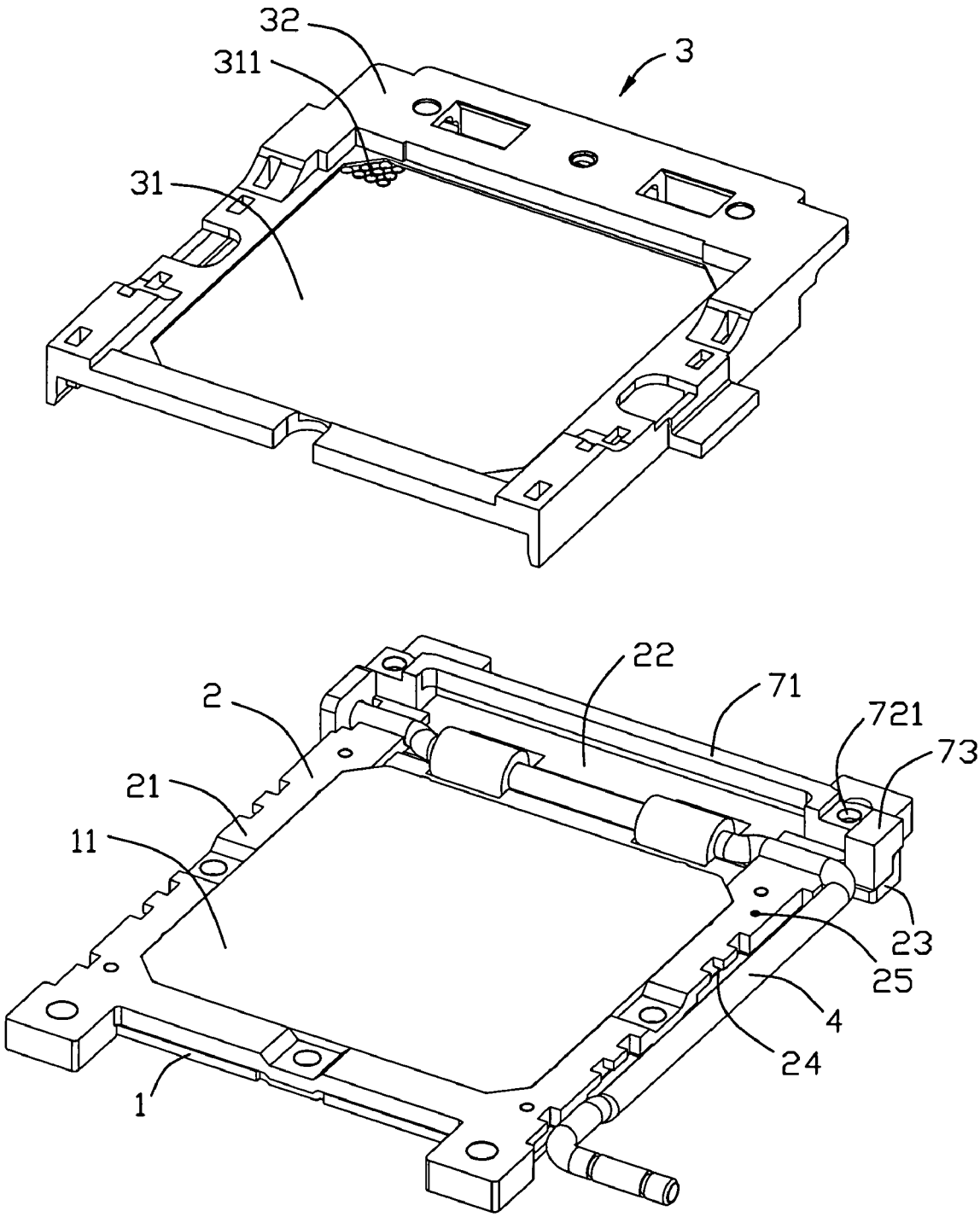
FIG. 5 is another partly exploded view of the connector.
Figure 8:
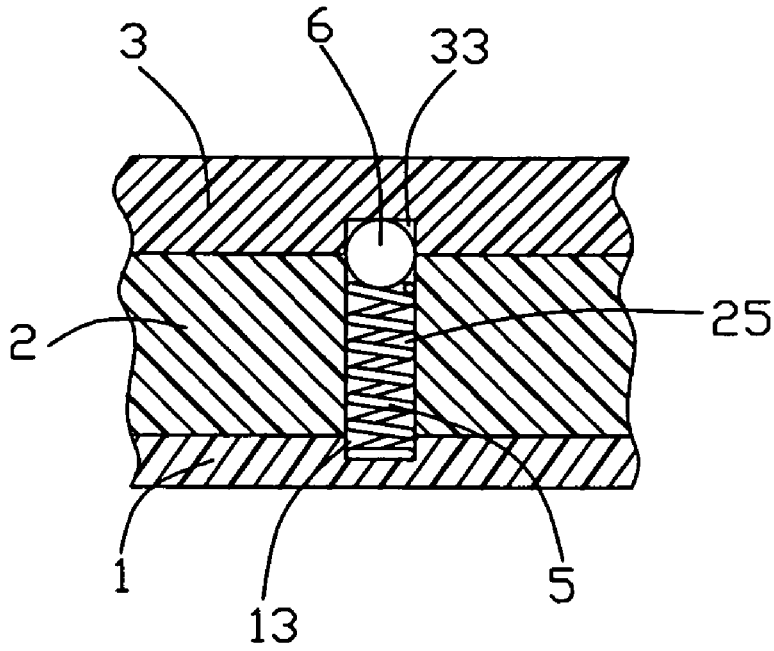
FIG. 8 is a sketch map of the elastic mechanism when the electrical connector is in a complete-open state.

The lever 4 is L-shaped and includes a handle 41 and a shaft portion 42 joined with each other at a right angle. The shaft portion 42 defines a pair of rollers 421. In assembly, the shaft portion 42 of the lever 4 is received in the first channel 221 with the free end retained into the through hole 224, and the rollers 421 are received in the corresponding communicating recesses 222, as best shown in FIG. 3. Referring to FIG. 5, the frame 2 is set onto the base 1 with the two opposite side portions 21 and the third side portion 22 mounted on the installing portion 12, the receiving portion 11 projects into an opening 26 defined in a center portion of the frame 2, and the through hole 25 aligns with the receiving hole 13, as best shown in FIG. 8. The frame 2 further defines a pair of posts 225 each at one end of the third side portion 22, and each post 225 defines a screw 226 therein, as best shown in FIG. 6.

Referring to FIG. 6, the elastic mechanism 8 defines a spring 5 and a ball bearing 6 engaging with the spring 5. The spring 5 is defined as an elastic member, and the ball bearing 6 is defined as a moveable member with an arc surface. The electrical connector further includes a fixing member 7 assembled to the frame 2. The fixing member 7 defines a base portion 71 and a pair of cubic fixing portions 72 extending from two ends of the base portion 71. A blocking portion 73 extends from one end of the fixing portion 72 and is located in a lower portion 23 which is defined at another end, opposite to the stopper 223 of the frame 2.

Referring to FIG. 5 and FIG. 6, the fixing member 7 is assembled on the third side portion 22 of the frame 2 with a pair of retaining holes 721 aligned with the corresponding screws 226, and a bolt (not shown) may twist into the holes 721 and the screw 226 to fix the fixing member 7 and the frame 2 together. The elastic member 5 and the moveable member 6 are both set into the through hole 25 and then received in the aligned through hole 25 and the receiving hole 13, the moveable member 6 is on top of the elastic member 5.

Figure 7:
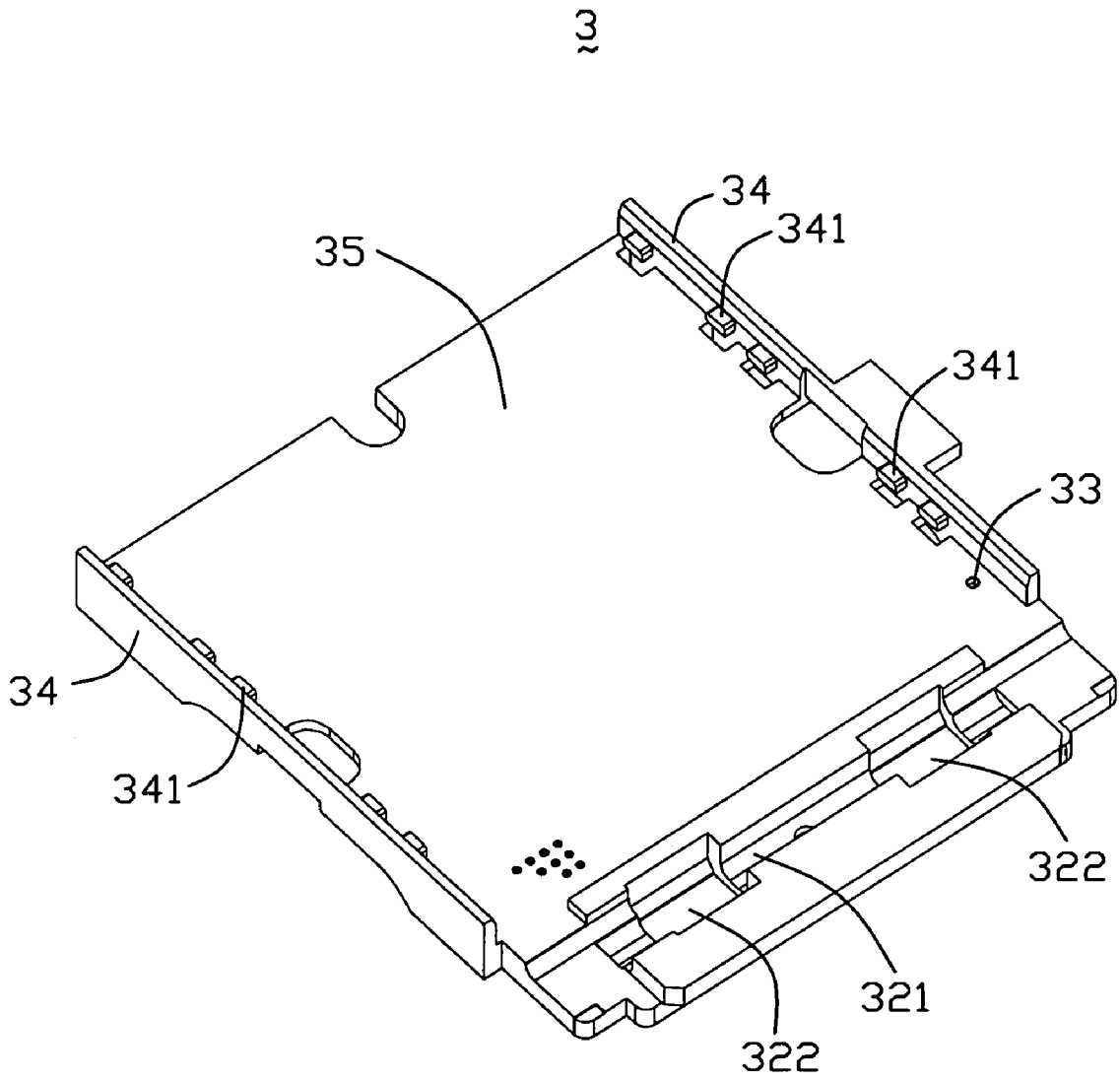
FIG. 7 is another view of the cover shown in FIG. 6.

Referring to FIG. 5 and FIG. 7, the cover 3 defines a supporting portion 31 and a cooperating portion 32. The supporting portion 31 defines a plurality of holes 311 extending vertically therethrough in alignment with the corresponding receiving grooves, respectively, so that the pins, which extend downward from the IC package component (not shown) may project downward through the corresponding holes 311 in the cover 3 and further into the corresponding receiving grooves in the base 1 for mechanically and electrically engagement with the corresponding terminals therein. The supporting portion 31 further defines a groove 33 running through a bottom face 35 thereof. The cooperating portion 32 includes a second opening-downward channel 321 with communicating recesses 322.

In assembly, the cover 3 is retained on the frame 2 with the protrusions 341 defined in two opposite sidewalls 34 retained in the corresponding recesses 24 defined in the frame 2. The shaft portion 42 of the lever 4 is received in the first and second channel 221, 321. The protrusions 331 are movably retained in the corresponding recesses 24 so that the cover 3 can move in a front-to-back direction relative to the base 1. The recesses 24 further can prevent the protrusions 341 from being off in the vertical direction. The groove 33 adjacent to the sidewall 34 is aligned with the slot 25, as best shown in FIG. 8.

Figure 9:
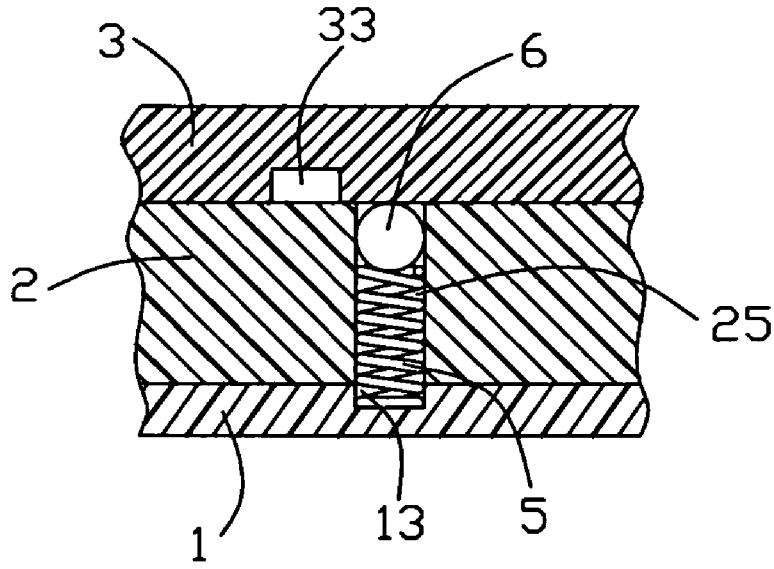
FIG. 9 is a sketch map of the elastic mechanism when the electrical connector is in a non-completely open state.

Referring to FIG. 9, the pins will mechanically and electrically engage with the terminals received in the base 1 when the handle 41 is in the horizontal position relative to the base 1, the groove 33 is in front of the through hole 25 and the cover 3 presses against the moveable member 6 to make the elastic member 5 compressed, the elastic mechanism 8 is received in the aligned through hole 25 and the receiving hole 13. During the handle 41 is turned from the horizontal position to the vertical position, the shaft portion 42 with the rollers 421 drives the cover 3 to move in a front-to-back direction, the cover 3 moves from a first position to a second position, and the pins are driven from contacting with the terminals. The groove 33 is above and aligns with the through hole 25, the elastic member 5 will restore and push the moveable member 6 partly into the groove 33, as best shown in FIG. 8, and the users will fell and know that the electrical connector is in the complete-open state. What's more, the handle 41 is retained in the vertical position by the moveable member 6 being blocked into the groove 33 by the elastic member 5, and the IC package is easy to be pulled out of the electrical connector and is unlike to damage the pins thereof. The blocking portion 73 may block the handle 41 to prevent the lever from further rotating, and the base portion 71 may prevent the cover from further moving backward.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for electrically connecting an integrated circuit to a circuit board, comprising:

a frame is a substantially rectangular configuration and including a front portion and a rear portion;

a cover moveably disposed on the frame and including a supporting portion with a plurality of holes defined therein;

a lever having a shaft portion disposed on the rear portion of the frame to drive the cover to move from a first position to a second position;

a base disposed within the frame and under the cover; and an elastic mechanism received between the base and the cover;

wherein the cover further defines a groove which is used for receiving the elastic mechanism when the cover is in the second position.

2. The electrical connector as described in claim 1, wherein the elastic mechanism defines an elastic member and a moveable member engaging with the elastic member, the groove receives the moveable member when the cover is in the second position.

3. The electrical connector as described in claim 2, wherein the groove runs through a bottom face of the supporting portion.

4. The electrical connector as described in claim 3, wherein the frame defines two opposite side portions, a through hole for receiving the elastic mechanism runs through one of the side portion and aligns with the groove when the cover is in the second position.

5. The electrical connector as described in claim 4, wherein the base defines an installing portion thereof, a side portion of the installing portion defines a receiving hole running through a top face thereof.

6. The electrical connector as described in claim 5, wherein the frame is mounted on the installing portion with the through hole aligning with the receiving hole, and the elastic member and the moveable member are received in the aligned receiving hole and the through hole.

7. The electrical connector as described in claim 6, wherein the moveable member is located on top of the elastic member and defines an arc surface engaging with the groove.

8. The electrical connector as described in claim 1, wherein the rear portion defines a first channel therein, the cover defines a second channel therein, and the first channel joins with the second channel to form a full channel enclosing the shaft portion.

9. The electrical connector as described in claim 1, wherein the electrical connector further defines a fixing member retained in the frame, the fixing member defines a blocking portion which prevents the lever from further rotating.

10. The electrical connector as described in claim 4, wherein the two side portions define a plurality of recesses therein, and the cover defines a plurality of protrusions movably retained in the corresponding recesses.

11. An electrical connector comprising:

a base unit having a receiving hole opening upwards;

a cover retained on the base unit and defining a groove open downwards;

a lever assembled between the base unit and the cover, the lever actuating the cover to move relative to the base unit in a first direction; and an elastic mechanism received in the receiving hole, the elastic mechanism being pressed under a bottom of the cover and an upper end portion of the elastic mechanism extending into the groove when the receiving hole is aligned with the groove in a second direction perpendicular to said first direction.

12. The electrical connector as described in claim 11, wherein the base unit includes a frame and a base disposed within the frame and under the cover.

13. An electrical connector comprising:

an insulative base unit including a plurality of terminals;

an insulative cover moveable relative to the base unit in a front-to-back direction and defining a plurality of through holes in alignment with the corresponding terminals, respectively;

a recess being formed in one of the cover and the base unit, and the other of said cover and base unit being equipped with an elastic member having thereof a retention head which is up and down moveable relative to the cover, and is received in the recess for minor retention when said cover is moved to a closed position to the base unit.

14. The electrical connector as claimed in claim 13, wherein the recess is formed in an underside of the cover, and the elastic member is upwardly extending from the base unit.

15. The electrical connector as claimed in claim 13, wherein said elastic member includes a coil spring and the retention head is of a ball like piece.

16. The electrical connector as claimed in claim 15, wherein said base unit defines a hole in which said coil spring is received.

17. The electrical connector as claimed in claim 13, wherein said base unit includes an insulative member and a metallic frame.

* * * * *